United States Patent [19]

Grosart

[11] 4,085,672

[45] Apr. 25, 1978

[54] INKING DEVICE

[76] Inventor: John Grosart, 14 Benedict Rd., Islington, Ontario, M9A 1X2 Canada

[21] Appl. No.: 753,071

[22] Filed: Dec. 21, 1976

Related U.S. Application Data

[63] Continuation-in-part of Ser. No. 612,505, Sep. 11, 1975, abandoned.

[51] Int. Cl.[2] ..... B41F 9/10

[52] U.S. Cl. ..... 101/169; 101/366

[58] Field of Search ..... 101/157, 169, 120, 123, 101/119, 124, 366; 118/259; 401/235, 272, 221, 261

[56] References Cited

U.S. PATENT DOCUMENTS

| | | | |
|---|---|---|---|
| 496,875 | 5/1893 | Haug | 401/221 |
| 2,151,969 | 3/1939 | Henderson | 101/157 |
| 2,168,229 | 8/1939 | MacArthur | 101/157 X |
| 2,177,656 | 10/1939 | Kaddeland | 101/157 |
| 2,630,065 | 3/1953 | Caulfield | 101/157 |
| 2,670,681 | 3/1954 | Pollock et al. | 101/157 X |
| 3,186,335 | 6/1965 | Gaulin | 101/157 |
| 3,307,466 | 3/1967 | Fukuda | 118/259 X |
| 3,871,776 | 3/1975 | Braun | 401/261 X |

FOREIGN PATENT DOCUMENTS

| | | | |
|---|---|---|---|
| 1,097,295 | 7/1955 | France | 101/157 |
| 282,786 | 7/1914 | Germany | 101/169 |
| 294,500 | 10/1916 | Germany | 101/157 |
| 369,114 | 2/1923 | Germany | 101/157 |
| 2,407,279 | 2/1974 | Germany | 101/120 |

*Primary Examiner*—J. Reed Fisher

*Attorney, Agent, or Firm*—Rogers, Bereskin & Parr

[57] ABSTRACT

A device for applying ink to a printing surface is described. The device includes two resilient ink flow control blades. The blades are deflected by contact with said surface to allow ink to flow onto the latter. The blades close to cut off the flow of ink as the device is lifted off the surface.

6 Claims, 18 Drawing Figures

FIG. 1
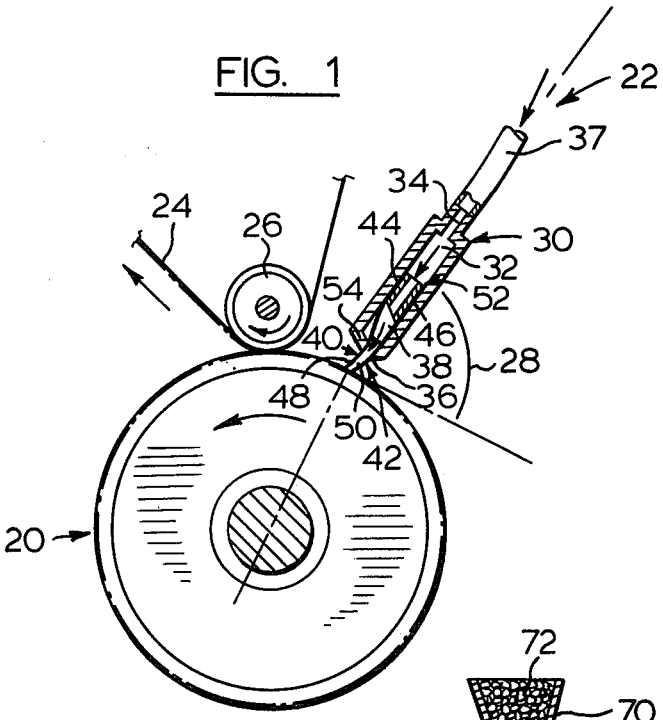
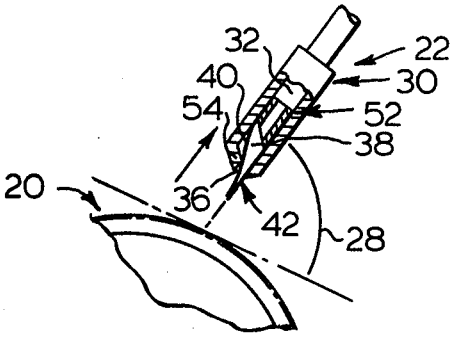
FIG. 1a
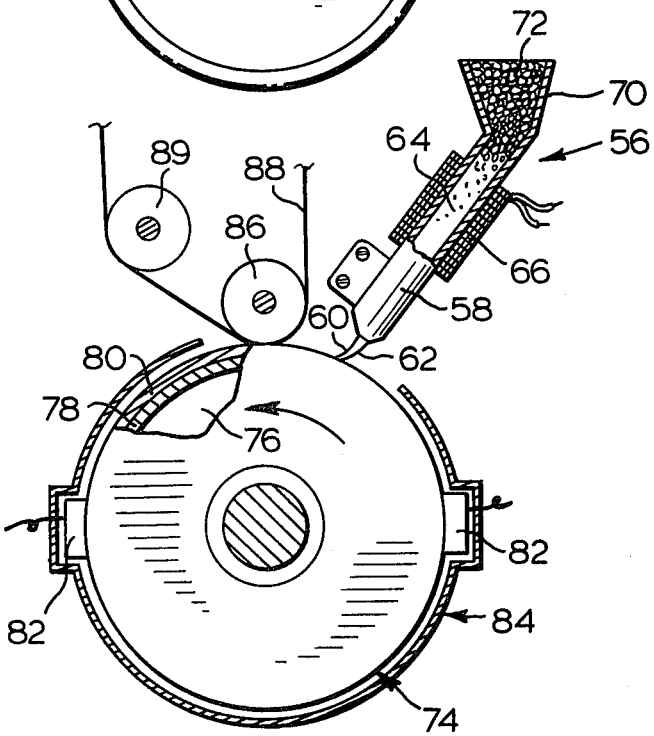
FIG. 2

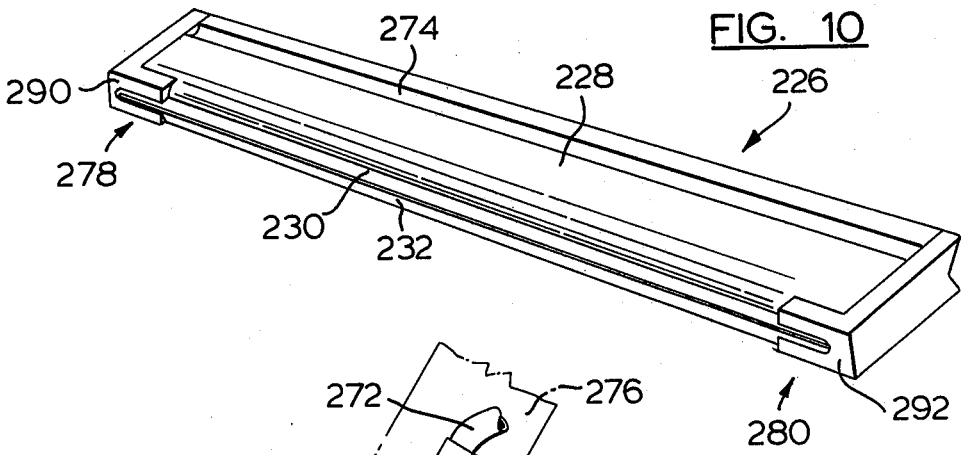
FIG. 10
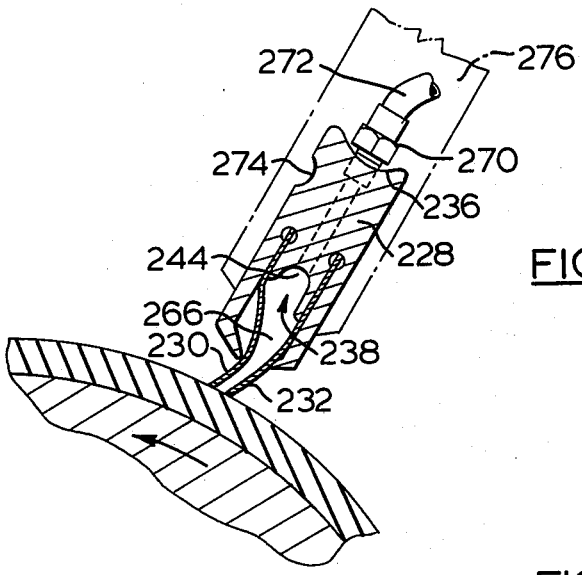
FIG. 11
FIG. 12
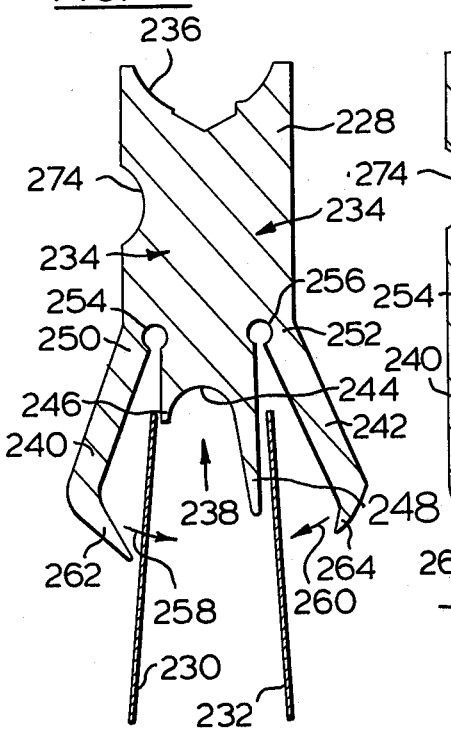
FIG. 13
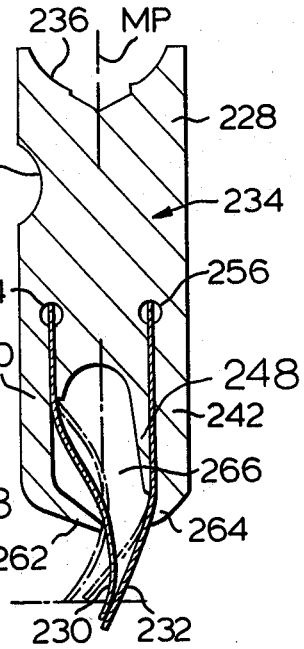
FIG. 14
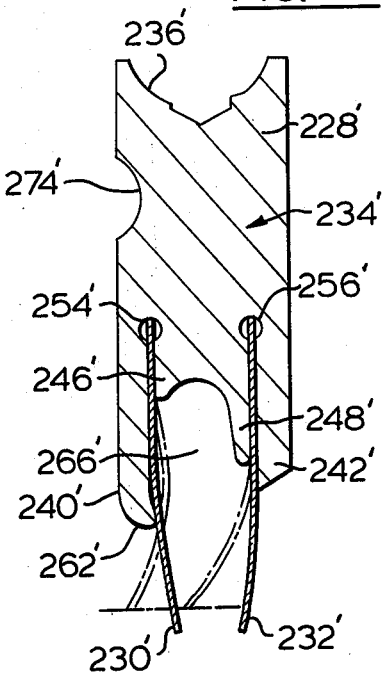

INKING DEVICE

This application is a continuation-in-part of application Ser. No. 612,505 filed Sept. 11, 1975 now abandoned.

This invention relates to a device for use in applying ink and the like to a printing surface. For convenience of description reference is herein confined to the application of ink. However, it is to be understood that the device of the invention may be used for applying other liquids, for example, lacquers and water.

In many conventional printing techniques, ink is applied to a printing surface from a trough in which a cylinder (or roller) rotates. The printing surface may be the peripheral surface of the cylinder itself or the cylinder may transfer the ink to a remote printing surface. This method of applying ink from a trough has numerous disadvantages. For example, such cylinders are often necessarily of substantial length. Since support rollers cannot conveniently be provided where an ink trough is used, sagging of the cylinder (known as "cylinder deflection") may be a problem. Also, where the cylinder is an impression cylinder, an impression can be taken only from the top of the cylinder, which has the disadvantage that gravity acts against transfer of ink to the paper being printed. Further, only one trough can be used with each cylinder with the result that only one impression can be taken per cylinder.

The present invention has been devised in connection with rotogravure printing (although the invention is not limited by this). Rotogravure is an intaglio printing technique in which the design to be printed is formed by recessed ink-carrying cells in the curved surface of a printed cylinder. The cells are arranged in the pattern of the design to be printed. Conventionally, the cylinder rotates in a trough of ink which floods the surface of the cylinder. A doctor blade positioned above the trough wipes excess ink off the cylinder so that the cells remain filled with ink for subsequent transfer to a web or sheet to be printed.

An object of the present invention is to provide an improved device for applying ink to a printing surface.

According to one aspect of the invention, the device includes a body adapted to be positioned adjacent the printing surface in use and two ink flow control blades coupled to the body in superposed positions in which one of the blades is a leading blade and the other blade is a trailing blade considered in the direction of relative movement between the device and the printing surface in use. The blades define respective inner portions which are coupled to the body in spaced positions, and respective outer portions which project from the body and which define parallel outer edges. The blades are arranged so that the outer portions normally make at least line contact with one another so that the blades define an ink chamber with said body. Sealing means are located at respectively opposite ends of the blades to define ends of said chamber. The device also includes inlet means in the body for delivery of ink to the chamber. The blades are resiliently deflectible upon contact with a printing surface in use so that their outer portions separate and allow the ink to flow onto said surface. The body defines external means engaging the trailing blade at a position intermediate its said inner end portion and its outer edge and defining a pivot arranged to cause the portion of the blade between its said inner end portion and said pivot to curve inwardly as the blades open upon contact with a printing surface so that the volume of the ink chamber remains at least substantially constant.

According to another aspect of the invention, there is provided a device which includes a body in the form of an elongate one-piece extrusion defining two spaced limbs extending longitudinally of the extrusion, and a central formation intermediate said limbs and defining with said limbs two longitudinally extending slots. The device also includes two blades having respective inner portions received in said slots in the body, said limbs of the body clamping the blades against said central formation. The blades project from the body and define an ink chamber with the body and parallel outer edges for contact with a printing surface in use. Sealing means are located at respectively opposite ends of the blades to define ends of said ink chamber. The device also includes inlet means in the body for delivery of ink to said chamber. In use, the device is arranged with the blades in contact with a printing surface and spaced from one another so that ink flows from the ink chamber between the blades and onto the printing surface.

The invention will be better understood by reference to the accompanying drawings which illustrate various embodiments of the invention by way of example. In the drawings:

FIG. 1 is a diagrammatic illustration of a device according to the invention in use for applying ink to a gravure printing cylinder;

FIG. 1*a* shows the device of FIG. 1 retracted clear of the cylinder;

FIG. 2 is a view similar to FIG. 1, diagrammatically illustrating an alternative form of inking device;

FIG. 10 is a perspective view from one end of an inking device according to a further embodiment of the invention;

FIG. 11 is a vertical cross-sectional view through the device of FIG. 10 in use;

FIG. 12 is an exploded vertical sectional view through the device of FIGS. 10 and 11 and illustrates a step in the manufacture of the device;

FIG. 13 is a view similar to FIG. 12 showing the device in the fully assembled condition;

FIG. 14 is a view similar to FIG. 13 showing a modified form of device;

Figure 3:
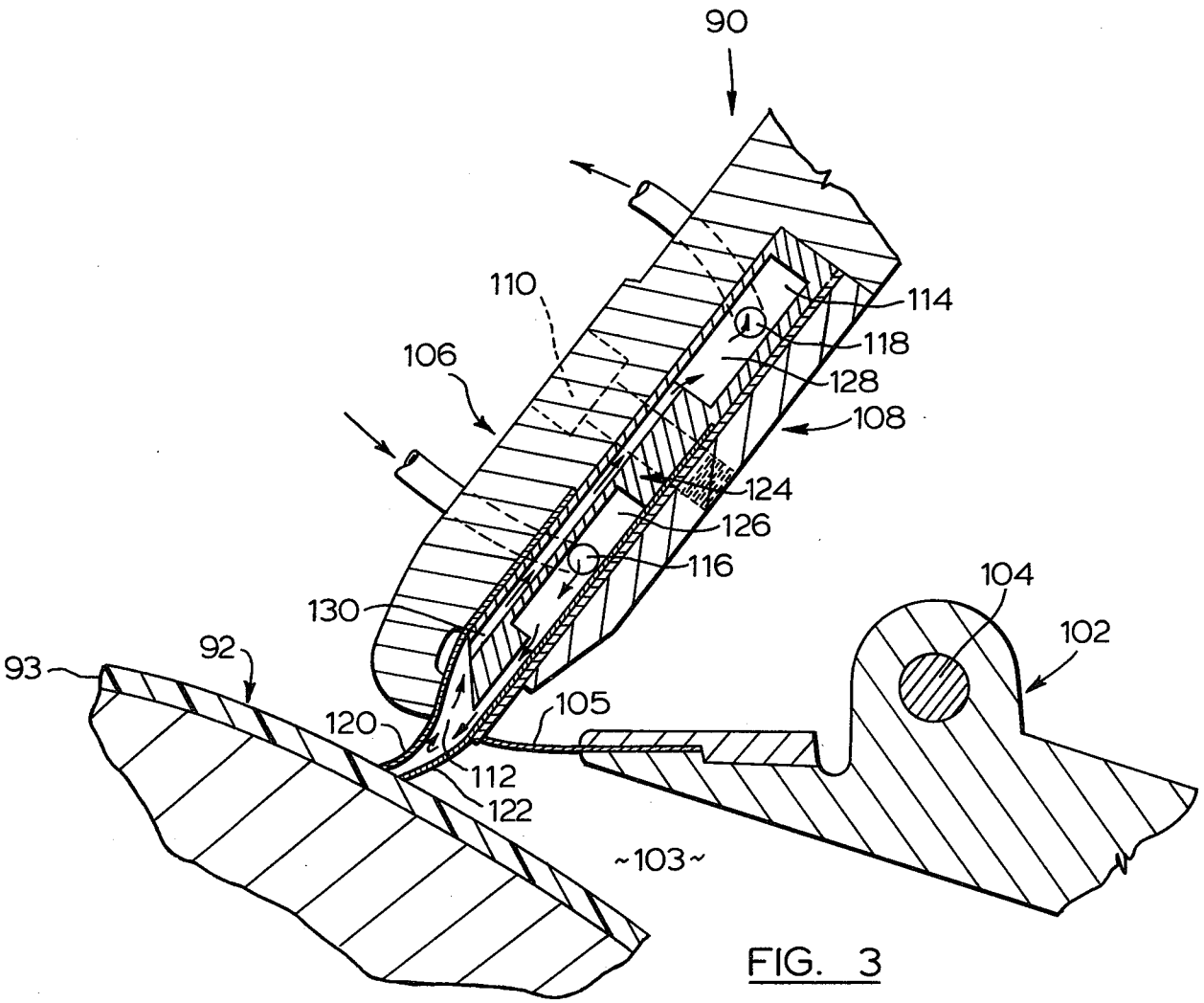
FIG. 3 is a vertical cross-sectional view through a conventional gravure doctor blade assembly converted to operate as an inking device according to the invention.

Referring first to FIGS. 1 and 1*a*, a conventional gravure printing cylinder is indicated at 20 in association with an inking device 22 according to the invention. A web of paper to be printed is indicated at 24 and is brought into contact with the surface of cylinder 20 in passing around an impression roller 26. The chain dotted outline at the periphery of the cylinder denotes a design to be transferred to the printed web. The design is in the form of recessed cells in the surface of cylinder 20, which cells are filled with ink by the inking device 22 for subsequent transfer to the paper web 24.

Device 22 operates to simultaneously ink and doctor the surface of cylinder 20 as will be described. The device is mounted on the frame of the printing machine (not shown) so as to be movable between the "on" position of FIG. 1 and the "off" position of FIG. 1*a*. Movement of the device may be effected manually or automatically from the controls of the machine by appropriate operating means (not shown in FIG. 1). In any event, the device is arranged in a plane at an angle of approximately 80° to a tangent to the surface of the cylinder 20 at the point of contact of the device with the cylinder. This angle is denoted 28 in FIGS. 1 and 1*a*. It is of course to be understood that the angle may be varied to suit particular printing conditions.

The device 22 includes a body 30 having an internal cavity 32 and an ink inlet 34 for the cavity. Cavity 32 opens into the forward end of the body at a slot 36 which extends generally parallel to the axis of cylinder 20. A supply tube 37 coupled to an ink reservoir (not shown) is connected to the inlet 34 to cavity 32. A continuous supply of ink is available to cavity 32 from the reservoir. The ink may be fed by gravity or under controlled pressure. Slot 36 receives two ink flow control blades 40, 42. The blades extend longitudinally of the slot 36 and are both made of relatively thin spring steel. In alternative embodiments, the blades may be plastic or combinations or laminations of plastic and steel. The blades are both of similar rectangular shape and include respective inner longitudinal portions 44, 46 located on respectively opposite sides of the slot 36. The blades also include respective outer longitudinal portions 48, 50 which project from the body 30 and which define parallel outer edges. The blades are trapped inside the body 30 by an insert 52 formed with a plurality of longitudinal passageways, one of which is visible in the drawings. The blades define an ink chamber 38 which communicates with cavity 32.

Referring to the direction of rotation of the printing cylinder 20 as indicated by the arrow in FIG. 1, blade 42 may be considered as a leading blade and 40 as a trailing blade. The trailing blade 40 acts as a doctor blade when the device is in use as will be described. FIG. 1*a* shows the inking device in the "off" position; that is the position in which the device is not inking. It will be seen that the leading blade 42 lies in surface contact with the bottom wall of cavity 32 and adopts an almost flat condition at this time. The trailing blade 40 on the other hand is deflected inwardly at its outer longitudinal portion by an inwardly directed formation 54 along the portion of body 30 which defines the upper wall of the slot 36. As a result, continuous surface contact is established between the outer longitudinal portions 48, 50 of the blades 40, 42 along marginal bands of the inner surfaces of the blades. Accordingly, the blades are normally "closed" when the inking device is out of contact with the cylinder as shown in FIG. 1*a*. At this time, ink is prevented from flowing from the ink chamber 38 between the outer longitudinal portions of the two blades. The spaces at respectively opposite ends of the blade assembly are sealed by a flexible sealing compound (not shown in FIGS. 1 and 1*a*) to be described later in connection with FIG. 5.

As can be seen from FIG. 1*a*, the leading blade 42 protrudes slightly beyond the outer edge of blade 40 in the position of FIG. 1*a*. This ensures that the blades close and cut off delivery of ink before moving out of contact with the cylinder when the inking device is moved from the "on" position to the "off" position.

It will be appreciated that the inking device will be in the "off" position of FIG. 1*a* at the commencement of a printing run. To commence printing, the device 22 is progressively moved from the position of FIG. 1*a* towards the position of FIG. 1. The blades 40, 42 are deflected by contact with the surface of the printing cylinder 20 so that their respective outer longitudinal portions 48, 50 are separated, allowing ink to flow onto the surface of the printing cylinder from the ink chamber 38. As the cylinder 20 rotates and ink is applied to its surface, the trailing blade 40 of the inking device simultaneously acts as a doctor blade to wipe surplus ink from the surface of the cylinder.

FIG. 2 shows an inking device in use in a printing system which employs solid "thermal" or "chill set" inks in the form of granules. This system had the advantage that volatile solvents and heat drying ovens are eliminated. The inking device is generally indicated at 56 and includes a body 58 and two blades 60, 62. In principle, the construction of the device is similar to that of FIG. 1; for this reason, details of the internal structure of the device are not shown. The device has an internal cavity 64 which communicates with the space between the blades 60, 62 and which is surrounded by precision thermostatically controlled heating elements 66. Cavity 64 has an inlet end fitted with a funnel 70. Ink in the form of solid resin granules 72 are placed in the funnel 70 and settle under gravity into cavity 64 where they are melted by the heating element 66. In an alternative embodiment, the ink may be delivered to device 56 through a heated tube from a heated reservoir. For the purpose of illustration only, it may be mentioned that typical melt temperatures for different coloured inks could be as follows: yellow — 200° F; red — 180° F; blue — 160° F; black — 140° F in order of laydown, so that the previous impressions are not affected.

In any event, the ink granules are melted by the heating element 66 and flow from the inking device under the control of the blades 60, 62 as described in connection with the FIG. 1 embodiment.

In FIG. 2, the printing cylinder is generally indicated at 74. The cylinder surface or plate is also heated. Cylinder 74 includes a cylindrical base 76, the curved surface of which is covered by a layer of an electrically and heat insulating material 78. A metal intaglio printing plate 80 is fitted around the insulating layer 78. A conventional rotogravure cylinder may be used provided an insulating layer is incorporated before plating. Carbon brushes 82 run in contact with the plate 80 of cylinder 74 and are used to apply a low potential electrical current to the plate 80 whereby the plate is electrically heated. Alternatively, the plate may be heated by radiation from suitable lamps.

In order to conserve heat, an apron 84 of a heat insulating material is fitted around the cylinder in close proximity to its outer surface. The apron is seen in cross-section only in FIG. 2. It is of generally cylindrical shape, and is gapped in the region of the inking device 56 and the impression roller 86 for the printing web 88. A chill roller 89 sets the ink before the next impression is made.

An apron such as apron 84 may be used in other embodiments when printing with highly volatile inks to conserve solvent and prevent drying of ink residue in the cells of the printing cylinder.

FIGS. 1, 1*a* and 2 are somewhat diagrammatic illustrations of inking devices according to the invention. FIG. 3 is a more detailed illustration of a conventional doctor blade assembly converted to form a device for simultaneously inking and doctoring a gravure cylinder. The device as a whole is generally indicated at 90 and is shown in use in association with a gravure printing cylinder 92 fitted with a plate 93. As is well known, the doctor blade assembly conventionally includes an apron which encloses the inking trough. In FIG. 3 a part of the apron is visible at 102. Part 102 is used to seal off the inking area 103. This device is pivoted to the frame of the machine at 104 and includes a blade 106 which is co-extensive with the inking device and which bears on the underside of the latter as shown in FIG. 3.

Device 90 includes a body made up of an upper part 106 and a lower part 108 coupled together by a series of screws spaced along the length of the device. One of the screws is visible at 110. Part 106 is in fact a conventional doctor blade holder and is coupled to the frame of the machine (not shown) in normal fashion. Conventional gravure cylinders are often of substantial length; the body of the inking device 90 will be of generally corresponding length. As in the case of the previous embodiments device 90 includes an ink chamber 112 which communicates with a cavity 114 in the body of the device. Cavity 114 has an ink inlet 116. However, the device of FIG. 3 differs from the previous devices in that the ink is circulated through the device and excess ink not used for printing is returned to a reservoir (not shown). For this reason, cavity 114 has an ink outlet 118. The inlet 116 and outlet 118 are positioned at respectively opposite ends of the inking device; inlet 116 is at the far end in FIG. 3. Also, the outlet 118 is disposed nearer the upper end of the device than the inlet 116. Inlet 116 and outlet 118 are coupled to a reservoir and associated pump arrangement (not shown) by which ink is delivered to inlet 116 under controlled pressure, travels along the device and is returned to the reservoir through outlet 118. When the device is being used for printing, some of the ink leaves the device between the ink flow control blades (denoted 120 and 122 in FIG. 3).

As in the case of the previous embodiments, the blades, together with the body of the device, define the ink chamber 112. Blade 122 is the leading blade and blade 120 is the trailing blade. The blades have respective inner longitudinal portions which are located inside the body on respectively opposite sides of the cavity 114. These portions of the blades are trapped between the respective parts 106, 108 of the body of the device, and an insert 124 located inside the cavity 114. Insert 124 is formed with two longitudinally extending passageways 126, 128 which communicate at respectively opposite ends with the respective inlet 116 and outlet 118. A plurality of transverse passageways, one of which is visible at 130 extend parallel to one another and communicate at their inner ends into passageways 126, 128. The arrows in FIG. 3 indicate the flow path of the ink inside the inking device.

The blades 120, 122 are positioned as in the previous embodiments so that they are closed when the inking device is out of contact with the cylinder 92 but are opened upon contact with the cylinder to apply ink thereto. Blade 120 simultaneously performs a doctoring function as described above.

Figure 4:
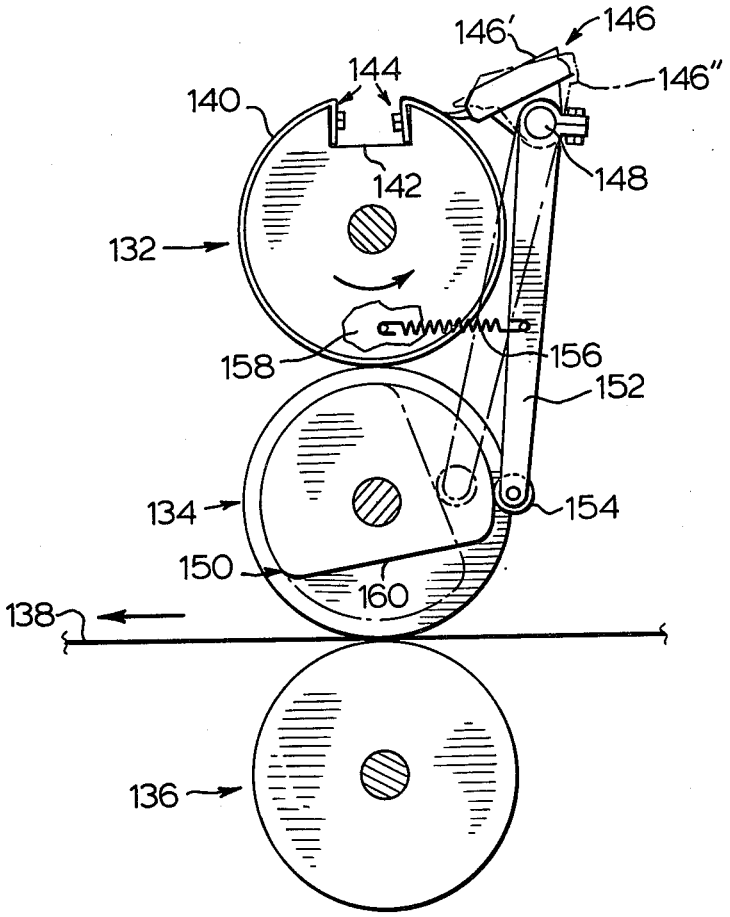
FIG. 4 is a diagrammatic side view of an inking device according to the invention in use in an offset printing installation.

FIG. 4 illustrates an arrangement in which an inking device according to the invention is applied to an offset printing machine. Only the principal cylinders of the machine are shown in FIG. 4. These are: a plate cylinder 132, a blanket cylinder 134 and an impression cylinder 136. A continuous web of paper is indicated at 138 passing through the nip between the blanket cylinder 134 and the impression cylinder 136. Of course, the machine could equally well be sheet fed. Plate cylinder 132 is a conventional offset cylinder fitted with a wrap-around intaglio printing plate 140 secured in an axial recess 142 in the cylinder by clamps 144. The blanket cylinder 134 and the impression cylinder 136 are also basically conventional. As is well known, ink is applied to the plate 140 of plate cylinder 132. The image on plate 140 is then transferred to the blanket cylinder 134 and from there to the web 138.

An inking device 146 is secured to a shaft 148 turnably mounted in the frame of the machine (not shown). The fact that the shaft 148 is turnable allows the inking device to move between the full line position 146' in which the device is in contact with the surface of the printing plate 140 (the "on" position) and the chain line position 146" in which the inking device is clear of plate 140 (the "off" position). The inking device is of the form shown in FIG. 5, which figure will be described later. For present purposes, it is sufficient to note that the device includes two ink flow control blades which operate as described in connection with the preceeding figures.

Due to the presence of a gap in the printing surface of plate 140 at the position of the recess 142, it is necessary to move the inking device 146 to the "off" position 146" once during each revolution of the plate cylinder 132 at the position of the gap so that the inking device in effect "jumps" the gap. This is achieved by means of an edge cam 150 mounted to rotate with the blanket cylinder 134. An arm 152 is coupled to the shaft 148 which supports the inking device and has at its outer end a cam follower 154 which runs on cam 150. A tension spring 156 urges arm 152 inwards at lower end. The spring is attached between the arm 152 and a part 158 of the frame of the machine. As can be seen, the cam 150 is profiled to define a "flat" 160. The cam follower 154 begins to move along the flat 160 as the gap in the printing plate 140 approaches the inking device 146. As the follower 154 runs along the flat, the inking device 146 is lifted clear of the cylinder and the supply of ink to the printing plate is cut off. When the follower 154 reaches the end of the flat 160, the inking device is returned to the surface of the printing plate and inking recommences.

Figure 5:
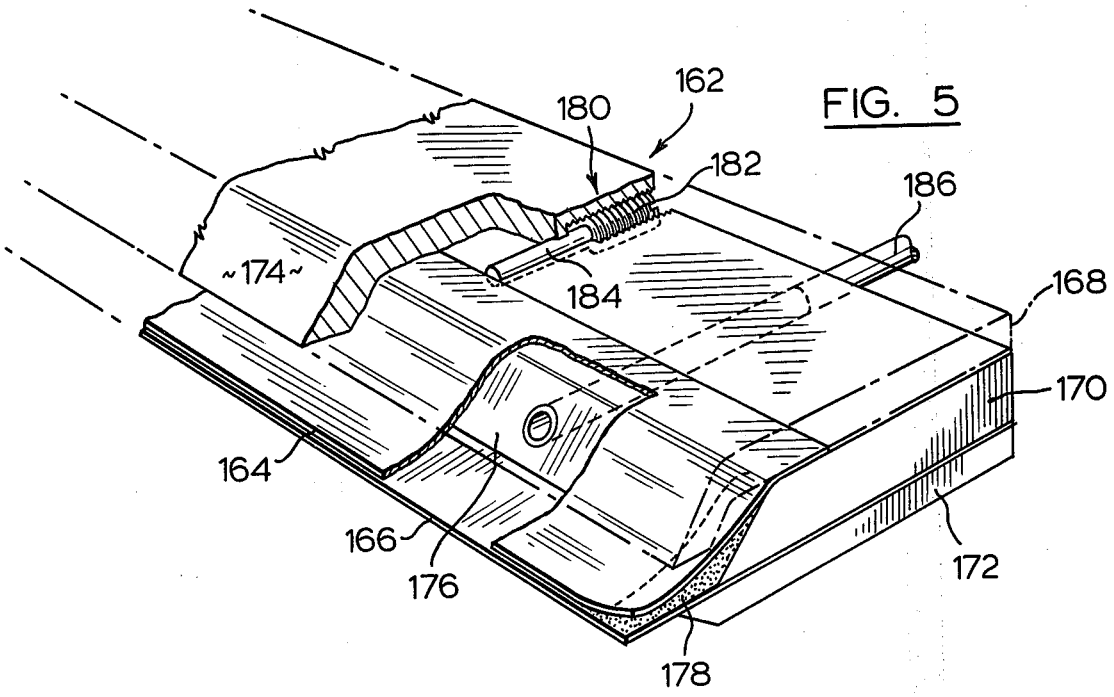
FIG. 5 is a perspective view, partly broken away, of one end of the device used in the arrangement of FIG. 4.

Referring now to FIG. 5, the inking device 146 will now be more specifically described. FIG. 5 shows only a part of the inking device and since the length of the device will depend on the length of the plate cylinder with which it is used. In some cases, the device may be several feet along.

The structure of the device is in principle similar to the devices described above. It includes a body 162 and two ink flow-control blades 164, 166. The body 162 is of three part construction comprising three specially shaped plates 168, 170 and 172. Blade 164 (the trailing blade) is trapped between the top plate 168 and the centre plate 170 and blade 166 (the leading blade) is trapped between plate 170 and bottom plate 172. FIG. 5 shows the inking device in its normal, inoperative position. It will be noted that blade 166 projects straight from the body 168 at this time and adopts an almost flat configuration. Blade 164 on the other hand is deflected downwardly by a depending formation 174 on the top plate 168. The blades are arranged so that the outer edges are in parallel superposed positions. As can be seen, the leading blade 166 projects slightly beyond the outer edge of blade 164.

Blades 164 and 166 together define an ink chamber 176 which is closed when the blades are in contact as shown. The ends of chamber 176 are sealed by plugs of a resilient sealant. One of these plugs is visible at 178 in FIG. 5. The sealant is applied when the blades are in their deflected "on" position so that the sealant is not stressed or is stressed to a minimal extent when the device is in use.

Both blades are adjustable by means of a series of screw assemblies spaced along the length of the inking device. One of these assemblies associated with blade 164 is generally indicated at 180 in FIG. 5; it will of course be appreciated that each blade of the device will be provided with at least two such assemblies spaced longitudinally of the device. Assembly 180 includes a screw 182 which is accessible from the rear of the device and which is received in a screw-threaded aperture formed between the top plate 168 and the centre plate 170 of the inking device. At its inner end, screw 182 bears against a pin 182 which in turn acts on the inner edge of the trailing blade 164. It will be appreciated that the extent to which the blades protrude from the body 162 can be controlled by turning the screws of the adjusting assemblies. It is primarily intended that such adjustment shall be carried out during initial assembly of the device since only minimal adjustment of the blades will be possible once the sealing plugs 178 have been applied. Of course, if necessary, the plugs could be removed to permit sharpening and adjustment of the blades, and subsequently replaced with fresh plugs.

Ink is delivered to the chamber 176 through a series of tubes which extend transversely of the device through the centre plate 170 of body 162. One of these tubes is visible at 186 in FIG. 5. Other similar tubes are provided at spaced intervals along the length of the device. The tubes are all connected to a gravity or pressure fed reservoir system as described above. In an alternative arrangement, ink may be arranged to circulate through the device as in the embodiment of FIG. 3.

Figure 6:
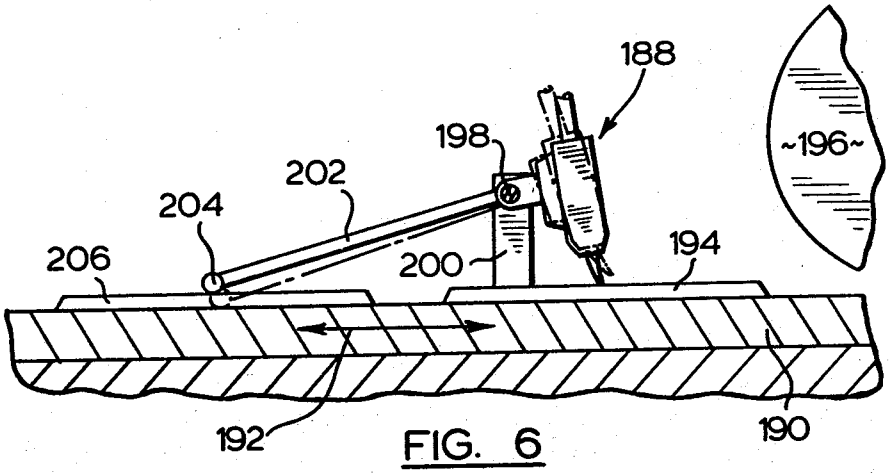
FIGS. 6 and 7 are side and end view respectively which diagrammatically illustrate a device according to the invention in use in a flat bed printing machine.
Figure 7:
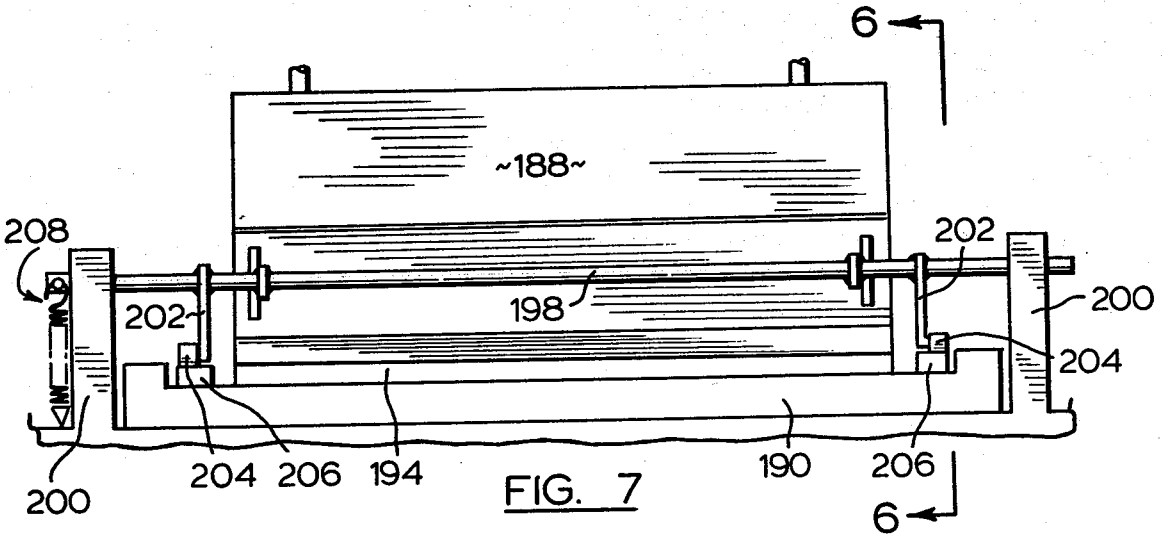

FIGS. 6 and 7 illustrate the application of an inking device according to the invention to a flat bed printing machine. The inking device is generally denoted 188 and is of similar form to the device shown in FIG. 5. The bed of the machine is indicated at 190 and reciprocates in the directions indicated by arrow 192. An intaglio printing plate 194 is mounted on the bed 190 and a cylinder of the machine is indicated at 196.

The inking device 188 is mounted on a shaft 198 turnably located in parts 200 (see FIG. 7) of the frame of the machine. Two arms 202 are coupled to respectively opposite ends of the shaft 198. Each arm 202 is provided at its outer end with a cam follower 204 which runs on a cam or bearer 206. The cams 206 are designed so that, as the bed 190 of the machine reciprocates the arms 202 are lifted at appropriate times to maintain the inking device 188 in contact with the printing plate 194. When they reach the ends of the cams 206, the arms 202 move downwardly at their outer ends, lifting the inking device. The cams are arranged so that the device is lifted adjacent respectively opposite ends of the printing plate 194. In other words, the inking device 188 occupies its operative "on" position only when the printing plate 194 is positioned below the device. A spring 208 (FIG. 7) maintains the followers 204 in contact with the cams 206.

Figure 8:
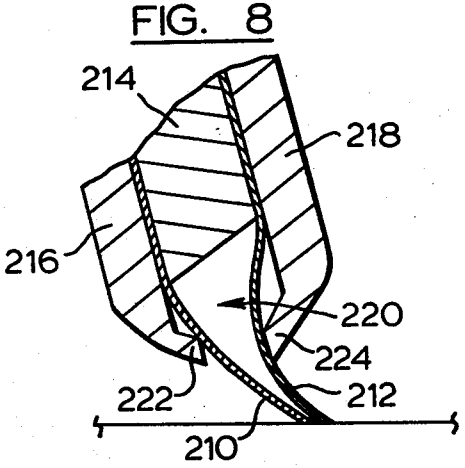
FIGS. 8 and 9 are vertical section views through an inking device in accordance with the invention and show the device respectively in the "on" and "off" positions.
Figure 9:
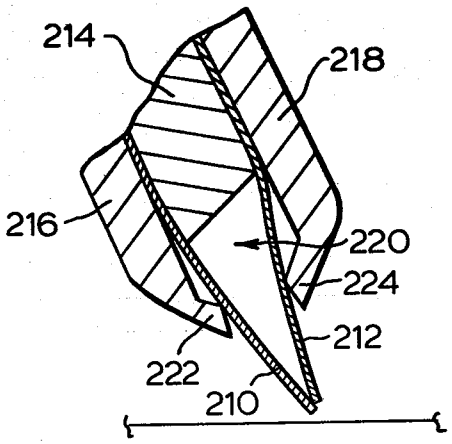

FIGS. 8 and 9 are diagrammatic sectional views through an inking device according to the invention and show the device respectively in "on" and "off" positions. The device includes two blades 210, 212 spaced by an insert 214 and located between two body parts 216, 218. Blade 210 is the leading blade and blade 212 is the trailing blade. The blades define an ink chamber 220. As can be seen, the outer edge of the leading blade 210 projects slightly beyond the outer edge of the trailing blade 212. This ensures that the outer edges of both blades remain in contact with the printing surface when the blades open.

In this embodiment, both body parts 216, 218 have inwardly directed formations 222, 224 respectively arranged so that both blades are always slightly curved in the same direction. Formation 224 in effect defines a pivot for blade 212 at a position intermediate its outer end and insert 214. As a result, the curvature of the inner portion **212*a* of blade 212 between formation 224 and insert 214 increases significantly when the device is moved from the "off" position (FIG. 9) to the "on" position (FIG. 8). This compensates for the increase in volume of ink chamber 220 which would otherwise occur as the outer ends of the blades open due to contact with the printing surface, with the result that the volume of ink chamber 220 remains substantially constant in both the "on" position and the "off" position of the device. This avoids or at least minimizes any increase in pressure in chamber 220** as the device moves between the "on" and "off" positions, which could cause leakage of ink between the blades.

FIGS. 10 to 17 of the drawings illustrate an inking device according to a further feature of the invention. This device is of relatively small overall dimensions and may be regarded as a compact, somewhat miniaturized version of the devices described previously. The intention is that the device shown in these views will be supplied as a non-adjustable throw-away unit. Thus, as is well known in the art, the doctor blades in conventional printing installations require to be sharpened periodically and adjusted to obtain optimum performance. In contrast, the devices shown in FIGS. 10 to 17 will be pre-set and non-adjustable. When the blades become worn or the device ceases to function efficiently, it will be discarded and replaced as a unit.

FIGS. 10 to 13, 15 and 16 show the same device. This device has self-closing blades and is intended for use in a situation in which the inking device is required to operate intermittently, for example as in an installation such as that shown in FIG. 4 of the drawings. The device of FIGS. 14 and 17 is essentially similar except that the blades are not self-closing. A device of this form is intended for use in a continuous mode in which the blades are always in contact with the printing surface.

Referring first to FIGS. 10 to 13, the device as a whole is generally denoted 226 and includes a body 228 and two flexible blades 230 and 232; blade 232 is the leading blade in this case. The blades may be of any of the materials described in connection with the preceding embodiments. Body 228 is formed from an extrusion. In this embodiment, the extrusion is aluminum although there is no limitation to this particular material. In other cases, it would even be possible to use plastic materials for the body.

FIG. 12 shows the cross-sectional shape of the extrusion used to form the body 228. The extrusion includes a main body portion 234 having a generally V-shaped groove 236 along one longitudinal edge. The opposite longitudinal edge of body portion 234 is shaped to define a central formation 238 and two side limbs 240 and 242, all of which extend longitudinally of body portion 234. Limbs 240 and 242 define with formation 238, two longitudinally extending slots which receive the blades 230 and 232. Formation 238 defines a semi-circular-section recess 244 having inner limbs 246 and 248 extending along opposite sides thereof. It will be noted that limb 248 is of significantly greater length than limb 246.

The outer limbs 240 and 242 of the extrusion are joined to the body portion 234 by narrow "neck" portions 250 and 252 respectively. Respective generally circular-shape passageways 254 and 256 are provided adjacent these "necks" and between the respective inner and outer limbs 246, 240 and 248, 242. In the extrusion as manufactured, the limbs 240 and 242 are outwardly angled as shown in FIG. 12. However, as a result of the narrow "neck" portions 250 and 252, the limbs 240 and 242 can be bent inwardly as indicated by the arrows 258 and 260 to co-operate with the inner limbs 246 and 248 of the central formation 238 and trap the blades 230 and 232 in the body 228 of the inking device.

In FIG. 12, the blades 230 and 232 are shown in exploded positions prior to insertion into the body of the device. Thus, the blades are introduced into the slots defined by the limbs 240 and 242 and the central formation 238 until the inner edges of the blades contact the walls of the respective passageways 254 and 256. The blades are dimensioned so that they are correctly positioned when fully inserted. The outer limbs 240 and 242 are then deflected inwardly in the directions of arrows 258 and 260 so that the blades are clamped between the respective inner limbs 262 and 248 of formation 238 and the outer limbs 240 and 242. If necessary, cement can be applied to the co-operating faces of the respective limbs and/or to the blades, before the limbs 240 and 242 are deflected. FIG. 13 shows the assembled device. The blades 230 and 232 are shown in full lines in their normal closed positions and in chain dotted lines in their open positions for applying ink to a printing surface.

It will be noted from FIG. 13 that the respective outer limbs 240 and 242 have inwardly angled outer end portions 262 and 264. These portions engage the blades 230 and 232 respectively and cause them to adopt the curved configurations shown in full lines, in which the outer longitudinal portions of the blades contact one another and define with the body 228 a sealed ink chamber 266. It will also be noted from FIG. 13 that the outer end portion 262 of limb 240 is longer than the corresponding portion 264 of blade 232; in fact, portion 262 terminates substantially on the median plane MP of the extrusion. Portion 262 defines a pivot for the trailing blade 230 so that the volume of the ink chamber 266 remains substantially constant when the blades move between their open and closed positions as described in connection with FIGS. 8 and 9. Also as described in connection with those views, the outer edge of the leading blade 232 extends slightly beyond the corresponding edges of the trailing blade 230. The fact that portion 262 of limb 240 is slightly longer than the corresponding portion of the other limbs of the extrusion allows two blades of the same length to be used while maintaining this differential in spacing between the outer edges of the blades.

In the embodiment shown in FIG. 14, primed reference numerals have been used to denote parts which correspond with parts shown in FIGS. 10 to 13. As explained above, the device shown in FIG. 14 differs from the device of the previous figures in that the blades are not self-closing. In the extrusion of FIG. 14, the inner and outer limbs 248' and 242' respectively of the body 228' are significantly shorter than the corresponding limbs of the extrusion shown in FIG. 13, and limb 242' has no inwardly directed outer end portion. Also, limb 240' is shorter overall and has a shorter outer end portion 262' than the corresponding parts of the extrusion shown in FIG. 13. Accordingly, the blades 230' and 232' in the FIG. 14 embodiment are always open. In that view, the blades are shown in full lines in their inoperative positions and in chain dotted lines in their operative positions in which they are in contact with the printing surface.

Ink is delivered to and, if necessary, removed from the ink chamber 266 by passageways 268 provided in the body 228 of the device and extending from the V-shaped groove 236 to the semi-circular recess 244 of the extrusion (see FIG. 11). As indicated in that view, the outer ends of these passageways may be internally screw threaded and fitted with unions 270 to which pipes 272 can be coupled. In a typical inking device, two passageways 268 would be provided adjacent opposite ends of the body 228. However, additional passageways could obviously be provided if necessary, for example, where the device is of unusual length.

It will also be noted from FIG. 11 that a groove 274 is provided in one side face of the body 228 of the device.

The primary purpose of groove 274 is to serve as an indication as to which way the device is intended to face when fitted to a printing machine. However, the groove may also serve to facilitate location of the device in a support assembly such as that indicated in chain line at 276 in FIG. 11. Assembly 276 may form part of a modified conventional doctor blade assembly such as that shown in FIG. 3 of the drawings, from which the doctor blade itself has been removed. However, it is to be understood that the inking devices shown in FIGS. 10 to 17 may be supported in any convenient fashion. In the simplest case, all that is required is a clamping arrangement for holding the device.

Figures 15, 16, 17:
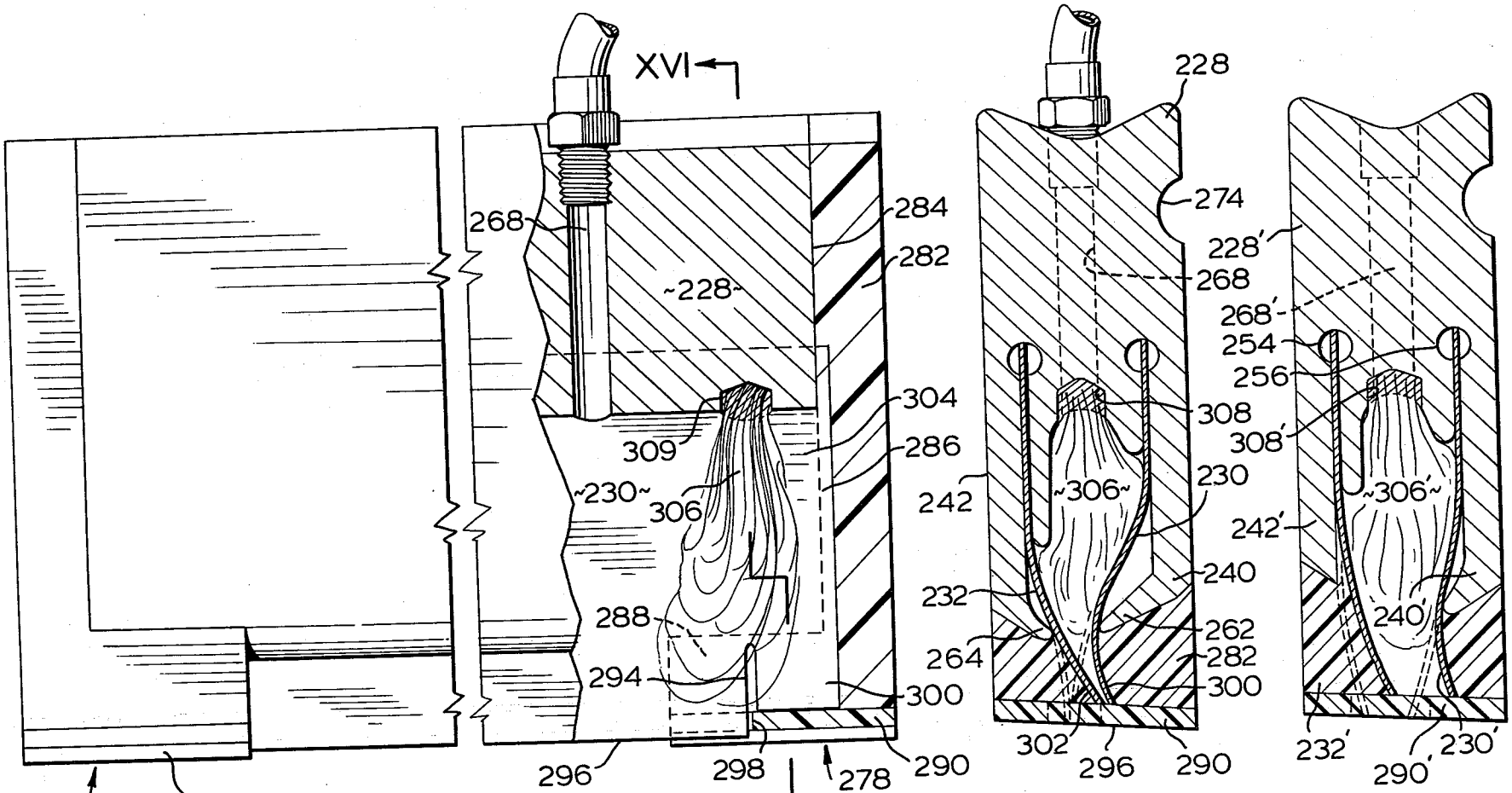
FIG. 15 is a plan view, partly in section, of the device of FIG. 13.
FIG. 16 is a transverse cross-sectional view on line XV1—XV1 of FIG. 15; and, FIG. 17 is a sectional view similar to FIG. 16 through the modified device of FIG. 14.

Referring back to FIG. 10, end seals 278 and 280 are provided at opposite ends of the device for sealing off the ink chamber 266. These seals will now be more specifically described with reference to FIGS. 15 and 16. In FIG. 15, part of the device has been broken away adjacent end seal 278 to show the seal in section. Part of the trailing blade 230 of the device is visible in the sectioned portion of FIG. 15 as is part of the body 228 formed with an ink passageway 268. A body 282 of a resilient sealing material is applied to the end face 284 of the body 228 of the device. It will be noted that the blades 230 and 232 protrude slightly beyond face 284 as indicated at 296. The protruding end portions of the blades are embedded in the sealant body 282. The sealant body also includes an inwardly extending portion 228 disposed on the exterior surfaces of the blades 230 and 232. As a result, the sealant body has a somewhat L-shaped appearance when viewed from externally of the device as can be seen more clearly in the case of the seal arrangement 280 in FIG. 15.

Applied to the portion 288 of the sealant body on the exterior surfaces of the blades 230 and 232 is a pad 290 of a low-friction material. In this embodiment, pad 290 is made of Teflon (TM) and the sealant is a silicone sealant, suitable examples of which are available from Dow Corning and General Electric. The pad 290 and a similar pad 292 at the other end of the device are in contact with the printing surface when the device is in use and ensure that the ink applied by the device is confined between the end seals.

Blade 230 is formed with a short slot 294 at a position spaced inwardly to a slight extend from its outer edge 286. The slot extends in the transverse direction of the blade; that is, normal to its outer edge 296. A similar slot is formed in the other blade 232 but this is not visible in FIG. 15. The Teflon pad 290 is formed with a slot 298 which is in line with the edges of the blades 230 and 232 and which extends from the inner end of the pad to a position just beyond the slot 294. The Teflon pad 290 is arranged so that the portions of the blades inwardly of the slots 294 protrude through the slot in the pad with their outer edges substantially even with the outer surface of the pad. The "corner" of blade 230 outwardly of slot 294, denoted 300, and the corresponding part of blade 232 are curved to a greater extent than the remainder of the blades and bear against the inner surface of the Teflon pad as can be seen in FIG. 16. The "corner" portion of blade 232 is denoted 302 in that view. These portions of the blades urge the Teflon pad against the printing surface when the device is in use to maintain a seal between the pad and the printing surface.

The space between the blades 230 and 232 adjacent to the body 282 of sealant is filled with a grease as indicated at 304. The purpose of the grease is to minimize the degree of contact between the ink in the device and the sealant. The grease is retained in the area adjacent the sealant by a brush-like body of cotton fibres 306 retained by cement in a small bore 308 in the aluminum body 228. The cotton fibres 306 extend outwardly from the aluminum body generally to the inner surface of the Teflon pad 290. In this embodiment, the grease 304 is a conventional automotive grease although other suitable materials could be used. Also, materials other than the cotton fibres 306 could be used to provide a barrier for retaining the grease. An example of a suitable material would be a foam plastic.

While only the end seal arrangement 278 has been specifically described, it is to be understood that seal 280 is similar.

FIG. 17 is a view similar to FIG. 16 showing the device of the form described with reference to FIG. 14 in which the blades of the device are not self-closing. The end seal arrangement used in this embodiment is essentially the same as that in the embodiment of FIGS. 15 and 16 and primed reference numerals have been used in FIG. 17 to denote parts corresponding with the previous views. However, in view of the similarity between the two arrangements, it is believed to be unnecessary to describe FIG. 17 in detail.

It should of course be noted that the preceding description applies to specific embodiments of the invention and that many modifications are possible within the broad scope of the invention.

For example, although specific forms of inking devices have been described in use in connection with particular types of printing machines it is to be understood that there is no limitation in this. Thus, the device of FIG. 5 could for example be applied to a printing machine of the type described in connection with FIGS. 1 to 3. Such a device could also be used for rotary letterpress type machines. converted to gravure printing and to replace the ink troughs on Flexographic machines. Inking devices are described above may also be applied to screen stencil printing.

In the accompanying drawings, the inking devices are all shown with approximately the same position in relation to the cylinder to which ink is being applied. It is to be understood that there is no limitation in this and that the inking device may be located at any position around the cylinder. Moreover, more than one inking device may be used in association with a single cylinder. For example, two or more devices each supplying a different coloured ink could be used. The devices could be positioned at different angular locations around the cylinder or they could be arranged at different axial positions along the length of the cylinder.

A multiple inking device arrangement may also be used to simultaneously take several impressions from on cylinder. For example, two or more webs may be run in contact with a single cylinder with an inking device arranged in advance of the point of contact of each web with the cylinder, thereby doubling or more the productivity of the press without increasing the speed.

The above examples are not necessarily exhaustively described since it is believed that the wide range of possible applications of the device will be readily appreciated by a person skilled in the art.

As is customary in conventional gravure doctor blade installations, provision may be made to continuously oscillate the inking device in the axial direction of the cylinder in association with which it is used. Such oscillation may be derived from a suitable low speed high torque motor coupled with the device through an appropriate mechanical arrangement designed to additionally allow movement of the device towards and away from the associated cylinder as described above.

Further, in some instances, it may be desirable to additionally provide a reverse doctor blade in association with the printing cylinder in advance of the inking device in order to remove from the cylinder "hickeys" (paper particles) and other foreign material which may be picked up from the web to avoid contaminating the ink applied by the inking device.

With reference to the range of application of the invention, the description with reference to the drawings relates to gravure printing, and to rotary offset and flat bed printing. It is to be understood that these are merely examples of possible applications of the invention. In fact, it is believed that the device of the invention may be used in any situation in which ink is to be applied either to a flat surface or to an intaglio type of surface in which the ink carrying part of the surface is recessed. Where the surface is flat, it may be necessary to balance ink pressure with the blade pressure to cause ink to be applied to the printing surface. Of course, the inking device need not apply the ink directly to a surface from which an impression is taken. The ink could be applied to an inking roller from which the ink would be transferred to the impression surface. Accordingly, the term "printing surface" as used in this specification and in the claims is to be interpreted as including any surface to which ink is applied.

In any arrangement in which the printing surface has a gap (e.g. as in FIG. 4), appropriate means will normally be provided to cause the inking device to "jump" the gap. These means may take a variety of forms. One example of a cam operated mechanism is shown in FIG. 4. In other cases, pneumatic, hydraulic, electrical or other devices may be used.

Where an inking device according to the invention is used in a situation in which the device is always in contact with the printing surface, the self-closing blade feature is not necessary. In this event, the device would not have to be moved out of contact with the printing surface to terminate delivery of ink to the surface. It would merely be necessary to cut off the supply of ink to the device.

What I claim is:

1. An device for applying ink to a printing surface, the device comprising:

a body in the form of an elongate one-piece extrusion defining two spaced limbs extending longitudinally of the extrusion, and a central formation intermediate said limbs and defining with said limbs two longitudinally extending slots;

two ink flow control blades having respective inner portions received in said slots in the body, said limbs of the body clamping the blades against said central portion, and the blades projecting from the body to define an ink chamber with the body and parallel outer edges for contact with a printing surface in use;

sealing means located at respectively opposite ends of the blades to define ends of said ink chamber; and, inlet means in the body for delivery of ink to said chamber;

whereby, in use, when the device is arranged with the blades in contact with a printing surface and spaced from one another, ink flows from the ink chamber between the blades and onto the printing surface.

2. An inking device as claimed in claim 1, wherein said extrusion includes a main body portion and two relatively narrow longitudinally extending neck portions coupling said two spaced limbs to said body portion, the extrusion being formed with said limbs in outwardly angled positions and said neck portions allowing the limbs to be deflected inwardly to clamp said blades against said central formation.

3. An inking device as claimed in claim 1, wherein said two spaced limbs define outer limbs of the extrusion, and wherein said central formation defines inner limbs extending parallel to said outer limbs and defining therewith said slots receiving the blades, and wherein each of said outer limbs has an inwardly directed outer end portion arranged to contact and inwardly deflect the associated blade, and wherein said inner limbs are dimensioned to co-operate with the respective outer limbs to determine the inward curvature of the blades.

4. An inking device as claimed in claim 3, wherein said blades are normally closed and are resiliently deflectible upon contact with a printing surface in use to open and allow ink to flow onto said surface, and wherein one of said blades is a leading blade and the other blade is a trailing blade considered in the direction of relative movement between the device and a printing surface in use, and wherein the outer limb of the extrusion associated with said trailing blade engages the blade at a position intermediate its said inner end portion and its outer edge and defines a pivot arranged to cause the portion of the blade between its said inner end portion and said pivot to curve inwardly as the blades open upon contact with a printing surface so that the volume of the ink chamber remains at least substantially constant.

5. A device as claimed in claim 1, wherein said sealing means comprises, at each end of said extrusion; a body of a resilient sealant adhered to said blades and extrusion and closing the relevant end of the ink chamber, said body of sealant including an inwardly extending portion enclosing an outer end portion of said outer edges of the blades; and a pad of a low friction material adhered to said inwardly directed portion of the sealant body and arranged for contact with a printing surface over which the inking device moves in use, and wherein each of said blades includes an outer edge portion disposed inwardly of said pad of low friction material and arranged to bias said pad into contact with said printing surface in use.

6. An inking device as claimed in claim 5, further comprising barrier means disposed in said ink chamber adjacent each of said sealant bodies for minimizing contact between ink in said chamber and said sealant body, each said barrier means comprising a barrier liquid which is imissible with ink to be used in the device, and which is disposed in the ink chamber adjacent the sealant body, and retaining means coupled to said body of the device and arranged to retain said barrier liquid in the end portion of the ink chamber.

* * * * *